United States Patent [19]

Wörz et al.

[11] 4,195,611

[45] Apr. 1, 1980

[54] CONSOLIDATED IGNITION TRANSFORMER AND CIRCUIT ASSEMBLY FOR AN INTERNAL COMBUSTION ENGINE IGNITION SYSTEM

[75] Inventors: Paul Wörz, Schwieberdingen; Reinhold Kaufmann, Oberriexingen; Karl Ehrmann, Stuttgart; Jörg Issler, Stuttgart; Günther Weiss, Stuttgart, all of Fed. Rep. of Germany

[73] Assignee: Robert Bosch GmbH, Stuttgart, Fed. Rep. of Germany

[21] Appl. No.: 916,348

[22] Filed: Jun. 16, 1978

[30] Foreign Application Priority Data

Mar. 18, 1978 [DE] Fed. Rep. of Germany ..... 2812029

[51] Int. Cl.[2] ..... F02B 77/00

[52] U.S. Cl. ..... 123/148 D; 123/148 E

[58] Field of Search ..... 123/148 R, 148 D, 148 E; 315/209 T

[56] References Cited

U.S. PATENT DOCUMENTS

| | | | |
|---|---|---|---|
| 2,462,491 | 2/1949 | Hallett | 123/148 D X |
| 3,260,299 | 7/1966 | Lister | 123/148 E X |
| 3,395,684 | 8/1968 | Minks | 123/148 D |
| 3,902,471 | 9/1975 | Brungsberg | 315/209 T X |

*Primary Examiner*—Tony M. Argenbright

*Attorney, Agent, or Firm*—Frishauf, Holtz, Goodman & Woodward

[57] ABSTRACT

An injection-molded cast aluminum base shell, open at the bottom and having individual openings at the top through which respectively protrude a part of the ignition transformer and a part of the transistorized circuit unit, in each case for external connections, consolidates enough of the circuit components to provide an assembly that can be mounted in an accessible portion of the motor compartment of a vehicle on the vehicle body structure to facilitate comprehensive maintenance attention.

9 Claims, 1 Drawing Figure

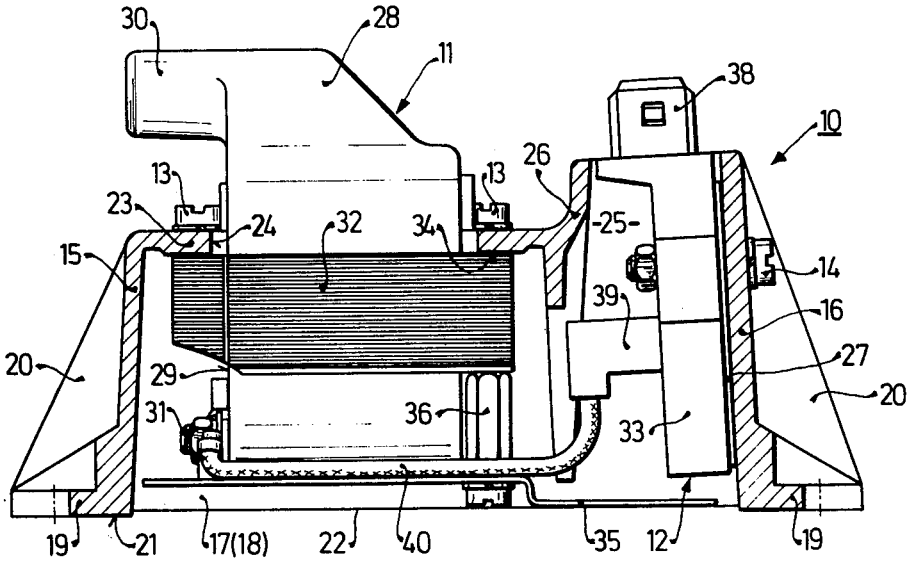
30
28
11
38
10
13
13
26
23
24
32
34
25
15
14
39
16
20
29
27
31
36
33
20
19
21
17(18)
22
40
35
12
19

CONSOLIDATED IGNITION TRANSFORMER AND CIRCUIT ASSEMBLY FOR AN INTERNAL COMBUSTION ENGINE IGNITION SYSTEM

This invention concerns a consolidated assembly of principal components of an ignition system to simplify the construction and servicing of internal combustion engines served by the ignition system.

Ignition system for internal combustion engines as presently known consist of separate components and assemblies of components electrically connected together, of which for example the ignition distributor and the spark plugs are mounted in or on the engine block and the ignition transformer, commonly referred to as the "spark coil," along with input resistors (in the case of a transistor controlled ignition coil) is fastened on the wheel box, as is also a circuit unit mounted in its own casing. With the multiplicity of individual assemblies and the relatively small space requirement, the arrangement and disposition of the assemblies is particularly difficult if unusual importance is given to good accessibility of the various assemblies for maintenance and repair.

It is an object of the present invention to improve accessibility of ignition system components for maintenance, repair and replacement by consolidating the transistorized circuit unit and the ignition transformer in a common physical assembly which can readily be disconnected and tested, or removed as a whole for servicing, particularly by taking these larger units of the ignition system into an assembly that can be fastened as a single piece to the vehicle body.

SUMMARY OF THE INVENTION

Briefly, a base shell member of heat-conducting material having four walls in substantially rectangular configuration, the open bottom of which, and particularly the mounting eyes provided at the bottom of at least two of these walls, define a mounting plane, is shaped particularly for mounting the ignition transformer and the transistorized circuit unit of the ignition system. Three of the four walls have an inward flange at the same distance from and parallel to the mounting plane, which flange defines an opening for the ignition transformer that is mounted on the flange, preferably by attaching the outer portion of its core thereto. The ignition transformer has its windings and the leg of the core on which the windings are wound encased in a generally cylindrical cast resin body from which the terminals of the primary winding and a terminal of the secondary winding protrude, preferably all three protruding from the same end face of the generally cylindrical body. The fourth wall of the base shell member, together with the two walls adjoining it and with a web contiguous both with the aforesaid flange and with the two walls adjoining the fourth wall, forms an extension shell open at the top so at least a connector portion of the transistorized circuit unit can protrude above it. The transistorized circuit unit is fastened to the fourth wall and preferably has a base plate of insulating material that is disposed parallel to the fourth wall in the mounted position of the unit, which is to say essentially perpendicular to the mounting plane.

The base shell member is preferably made of cast aluminum and preferably has cooling fins extending outward from those walls which carry the mounting eyes, which also extend outwards. The ignition transformer is mounted so that all of the core is inside the base shell member.

The invention has the advantage that the ignition transformer can be one which does not have an individual external casing. A protective coating on the outer portion of the transformer core is not necessary because the core is protected within the base shell member.

The invention is further described by way of illustrative example with reference to the annexed drawing, in which:

The FIGURE shows a cross section of the base shell member and a side view of the components mounted therein and therethrough, the cross section being in the long dimension of the base shell member.

As shown in the drawing, the consolidated ignition system assembly of the invention consists essentially of a base shell member 10, which could be described as a casing open entirely at the bottom and also to a large extent at the top, made of cast aluminum (preferably by an injection molding process in which the molten metal is supplied to the mold under pressure), an ignition transformer 11 mounted therein by means of four screws 13 and a circuit unit also mounted therein, in this case by two screws 14. This assembly forms a mounting unit that is preferably designed to be screwed into a portion of the vehicle body enclosing the motor compartment.

The casing 10 has four side walls 15 to 18, of which the wall 18, lying in front of the plane of the FIGURE, is arranged in mirror image relation to the wall 17 that appears in that figure. Four mounting eyes 19 in all, in this case in the form of laterally extending feet, each perforated for a screw, stick out from opposite side walls 15 and 16, and a cooling fin 20 is cast onto the gusset formed by the wall and mounting eye in each case. The four mounting eyes 19 define a mounting surface 21 and the four side walls 15 to 18 leave open the underside 22 of the base shell member or casing 10. The three walls 15, 17 and 18 have a flange 23 at the top at the same spacing from and parallel to the mounting surface 21. This flange defines and runs around an opening 24.

The primary and secondary windings of the ignition transformer 11, which are not themselves visible in the drawings, are encased in a body 28 of cast resin that is molded in generally cylindrical shape. From one end face 29 of this generally cylindrical body 28 there extend the secondary winding connection 30 and the two primary winding terminals 31. A laminated iron core 32 for the ignition transformer consists of an E-shaped core portion and a T-shaped core portion. The iron core 32 lies flush against the underside 34 of the flange 23 and is held in this position by the four screws 13. A cover 35, screwed onto the iron core 32 but spaced therefrom by a spacer 36, essentially closes off at the bottom the underside of the space enclosed by the base shell member 10.

The wall 16, to which the flange 23 does not extend, forms, together with the adjacent walls 17 and 18 and a connecting web 26 which is contiguous with the walls 17 and 18 as well as with the flange 23, a kind of extension shell or partial enclosure for the transistorized circuit unit 12 providing an opening at the top through which an end of the circuit unit including a connector 38 for the circuit unit 12 can protrude.

The transistorized circuit unit 12 has a main body 33 encased in synthetic resin for instance opoxide resin with filler, and is provided with a mounting plate 27 in the illustrated case. The circuit unit 12 and its mounting plate 27 lie against the inner surface of the side wall 16 of the base shell member. Two screws 14, of which only one is visible in the FIGURE, secure the circuit unit 12 in its operating position. Two cables 40 respectively connect the two primary winding terminals 31 with two terminals of the circuit 12, the latter being in the form of plug and socket connections 39, only one of these cables 40 and one set of terminals 31, 39 being visible in the FIGURE.

Although the invention has been described with reference to a particular illustrative embodiment, it will be recognized that variations are possible within the inventive concept.

Although reference has been made to the top and bottom of the shell member 10, it should be understood that the assembly illustrated can be mounted on a vertical mounting surface, as well as on a horizontal one or an oblique one, and that the term "bottom" refers only to the attitude of the assembly when stored on a shelf and not necessarily to the attitude of the assembly when mounted in operating position.

I claim:

1. A consolidated ignition system assembly for an internal combustion engine, comprising:

an ignition transformer embedded in a body (28) of cast resin encasing the primary and secondary windings thereof and the portion of the iron core thereof passing through said windings, said body being of generally cylindrical shape, said transformer having primary winding terminals (31) and a secondary winding terminal (30) extending from said body;

a transistorized circuit unit (12);

a base shell member of heat-conducting material having four walls in substantially rectangular configuration defining a mounting plane at an open bottom formed by said walls and having mounting eyes at the bottom of said walls, three of said walls having an inward flange (23) at the same distance from and parallel to said mounting plane, said flange defining an opening (24) for said ignition transformer (11), said ignition transformer being mounted on said flange from the underside thereof, a fourth wall (16) and the two of said walls adjacent to said fourth wall forming, together with a web (26) contiguous to said flange and to said two walls adjacent to said fourth wall, a shell extension having an opening at the top, in addition to being open at the bottom, for partially enclosing said transistorized circuit unit and for allowing at least a connector thereof to protrude upwardly out of said base shell member, said transistorized circuit unit being mounted on said fourth wall of said base shell member.

2. A consolidated ignition system assembly as defined in claim 1, in which said transistorized circuit unit is encased in resin and has a flat base side and in which said transistorized circuit unit fastened to said fourth wall of said base shell member so that said base side thereof is close to said fourth wall and disposed substantially perpendicular to said mounting plane.

3. A consolidated ignition system assembly as defined in claim 1, in which said terminals of said windings of said ignition transformer extend from the same end face of said generally cylindrical body (28).

4. A consolidated ignition system assembly as defined in claim 1, in which two of said mounting eyes (19) are provided on each of two mutually opposite walls (15, 16) of said four walls and together define said mounting plane (21).

5. A consolidated ignition system assembly as defined in claim 1, in which a cover (35) is provided for closing off the open underside (22) of said base shell member, said cover being affixed to the iron core (32) of said ignition transformer (11).

6. A consolidated ignition system assembly as defined in claim 2, in which said transistorized circuit unit provided with a mounting plate (27) on its flat base side and in which said transistorized circuit unit and said mounting plate (27) are fastened to the inner side of said fourth wall by screws (14).

7. A consolidated ignition system assembly as defined in any one of the preceding claims, in which said base shell member is made of cast aluminum.

8. A consolidated ignition system assembly as defined in claim 7, in which at least those of said four walls (15, 16, 17, 18) of said base shell member (10) on which mounting eyes (19) are provided, also have cooling ribs (29) extending out from said walls.

9. A consolidated ignition system assembly as defined in any one of claims 1–6, in which at least those of said four walls (15, 16, 17, 18) of said base shell member (10) on which mounting eyes (19) are provided, also have cooling ribs (20) extending out from said walls.

* * * * *